United States Patent [19]

Blessing

[11] Patent Number: 4,941,333

[45] Date of Patent: Jul. 17, 1990

[54] CENTRIFUGALLY DRAINING SINGLE DRUM WASHING MACHINE

[75] Inventor: Hubert Blessing, Dallas, Tex.

[73] Assignee: Levi Strauss & Co., San Francisco, Calif.

[21] Appl. No.: 304,968

[22] Filed: Jan. 31, 1989

[51] Int. Cl.[5] ..... D06F 23/02; D06F 25/00; D06F 37/06; D06F 39/08

[52] U.S. Cl. ..... 68/19.2; 68/24; 68/58; 68/142; 68/207; 68/208

[58] Field of Search ..... 68/19.2, 24, 38, 58, 68/60, 139, 140, 142, 144, 207, 208; 69/30

[56] References Cited

U.S. PATENT DOCUMENTS

| | | | |
|---|---|---|---|
| 14,818 | 5/1856 | King | 68/144 X |
| Re. 23,626 | 3/1953 | Castner | 68/23 |
| 383,707 | 5/1888 | Craig et al. | 68/24 X |
| 408,690 | 8/1889 | Burton et al. | 68/58 X |
| 604,086 | 5/1898 | Rising . | |
| 801,627 | 10/1905 | Wunsch | 68/144 X |
| 1,943,709 | 1/1934 | Wilkins | 68/18 |
| 2,354,208 | 7/1944 | Haberstump | 68/142 X |
| 2,370,285 | 2/1945 | Beede et al. | 68/144 |
| 2,397,268 | 3/1944 | Jorgenson et al. | 68/144 |
| 2,434,570 | 1/1948 | Leef | 68/144 |
| 2,534,267 | 12/1950 | Kahn | 68/139 X |
| 2,586,794 | 2/1952 | Douglas | 68/142 |
| 2,615,320 | 10/1952 | Belaieff | 68/24 |
| 2,637,189 | 5/1953 | Douglas | 68/144 X |
| 2,687,633 | 8/1954 | Sharp et al. | 68/23 |
| 2,770,120 | 11/1956 | Walton | 68/28 |
| 2,770,121 | 11/1956 | Kuntz | 68/38 |
| 2,800,786 | 7/1957 | Schang | 68/58 |
| 2,867,106 | 1/1959 | Stone, Jr. et al. | 68/24 |
| 2,955,451 | 10/1960 | Delos | 68/28 |
| 3,006,176 | 10/1961 | Behrens | 68/12 |
| 3,039,285 | 6/1962 | Smith | 68/144 X |
| 3,270,529 | 9/1966 | Engel | 68/18 |
| 3,388,410 | 6/1968 | Marshall | 8/158 |
| 3,466,904 | 9/1969 | Huni | 68/144 X |
| 3,583,180 | 6/1971 | Arbogast | 68/5 C |
| 3,603,118 | 9/1970 | Brucken et al. | 68/23 |
| 3,997,292 | 12/1976 | Lutes et al. | 8/158 |
| 4,020,659 | 5/1977 | Bhavsar | 68/27 |
| 4,489,574 | 12/1984 | Spendel | 68/16 |
| 4,498,317 | 2/1985 | Thysen et al. | 68/24 X |
| 4,557,120 | 12/1985 | Sundman | 68/58 |

*Primary Examiner*—Philip R. Coe

*Attorney, Agent, or Firm*—Limbach, Limbach & Sutton

[57] ABSTRACT

A water tight, single, horizontally rotatable drum washing machine is provided. The frustum interior shape of the drum combined with the centrifugal force generated by rotating the drum moves liquids in the drum to the base of the frustum where the liquids can be removed. The washing machine may be adapted for use as a garment dryer by providing a source of forced air, or for a variety of other garment processing steps, such as dyeing, thus enabling the complete finishing of garments in one operation.

26 Claims, 2 Drawing Sheets

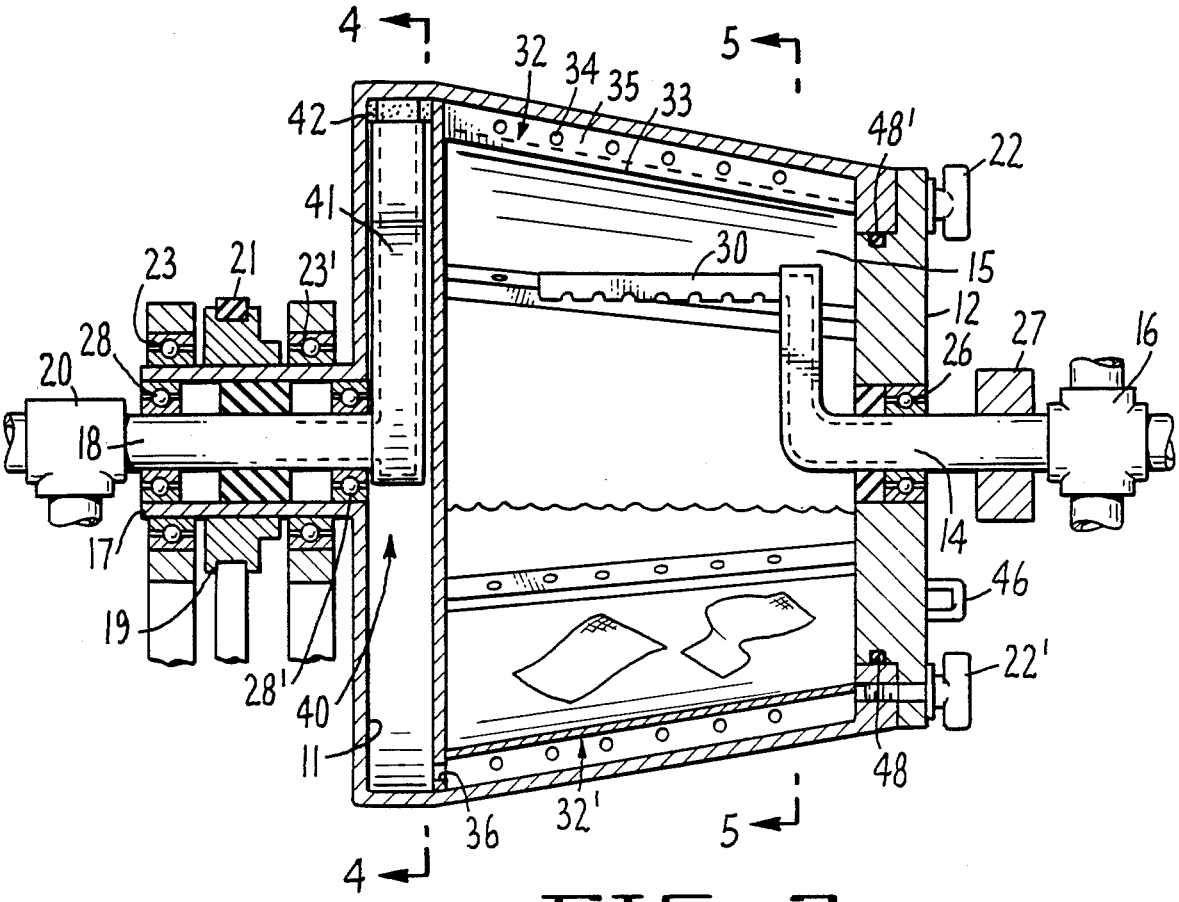
FIG. 3.
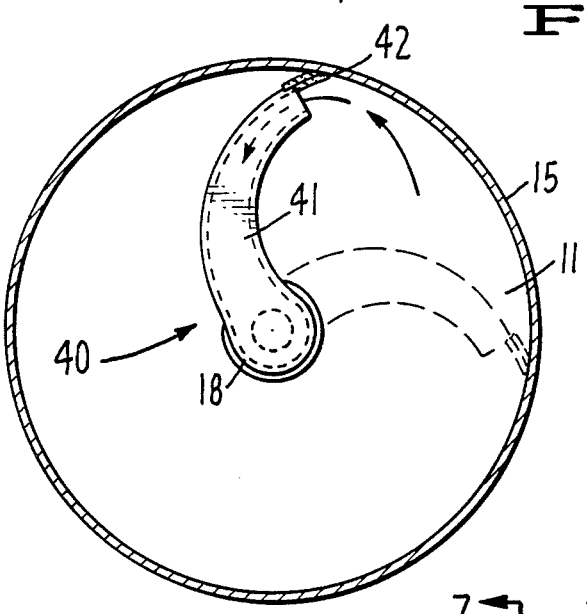
FIG. 4.
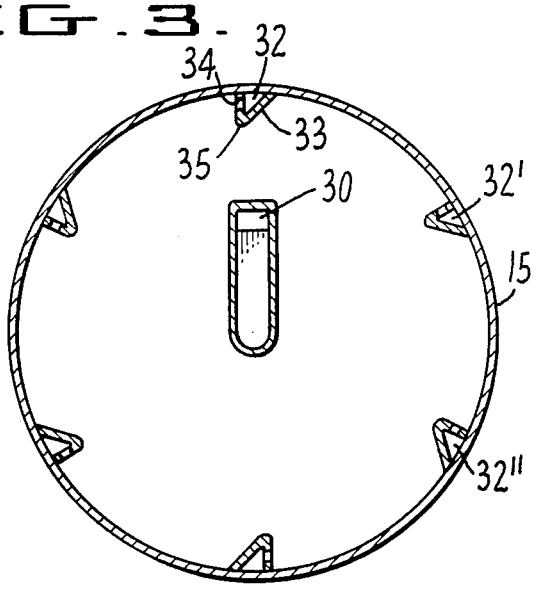
FIG. 5.
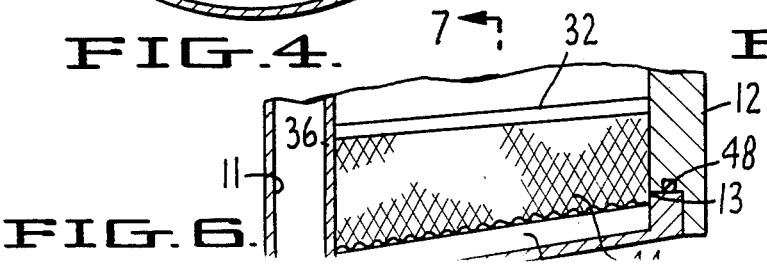
FIG. 6.
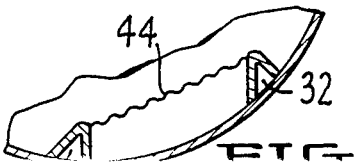
FIG.

CENTRIFUGALLY DRAINING SINGLE DRUM WASHING MACHINE

TECHNICAL FIELD

The present invention relates to washing machines. In particular, the present invention provides a multipurpose fabric finishing machine having a single, liquid impermeable, rotating drum.

BACKGROUND ART

Washing machines are well known in the art. Commercial washing machines, in particular, may be used to clean a large volume of soiled fabrics, garments and linens (referred to collectively in this application as "garments"), or may be used by garment manufacturers to process large lot quantities of garments to remove fabric sizing, to dye, and to produce a "stone washed" effect by agitation in the presence of mechanical or chemical agents.

Conventional washing machines are commonly constructed using two cylindrical drums in which a movable perforated drum is placed within a stationary, watertight drum. Such interior perforated drums are generally rotated about a central axis and may contain vanes or other structures for agitating clothing. During the wash cycle, water is introduced into the water tight drum and passes through the perforations into the interior drum where the garments are placed for washing. When the appropriate amount of water has been delivered, a sensing mechanism switches off the valve between the water source and the washing machine and switches on an electric motor or other such means for rotating the interior drum. Agitation of the water and garments is usually accomplished by slowly rotating or moving the interior drum. When the wash cycle is complete, a switching device opens a valve at the lowest point on the watertight drum, and the water drains out by gravity or is pumped out using a vacuum pump. To aid in further removal of excess water from the garments, a spin cycle is often provided in which the inner drum is rotated about the axis of rotation at a high speed in one direction; the garments are forced against the wall of the perforated drum and excess water is forced from the garments through the perforations and into the stationary watertight drum by centrifugal force, where it drains by gravity or is pumped from the drum. In garment manufacturing, many such cycles can be used to process garments; for example, garments may be washed once to remove fabric sizing, a second time to dye the garments, and yet a third time to chemically or mechanically process the garments. To produce "stone washed" garments, the interior of the drum in such commercial washing machines may be provided with an abrading surface or chemicals may be introduced to give the garments the softer and slightly faded "stone washed" appearance.

Such two drum conventional washing machines are, however, difficult to empty of the garments, particularly when the washing machines are commercial washing machines having a large capacity, such as would be used by garment manufacturers. The machines are also difficult to clean because the perforated, rotating drum is not usually removable, so that the interior portions of the watertight drum are not accessible. Thus, residual amounts of dye or chemicals may remain which could interfere with subsequent wash cycles involving new batches of garments. Further, such machines use more water, detergent, dye and chemicals than are really needed because the vertical space between the two tanks must be filled before the wash solution will enter the perforated tank to wash the garments. Finally, in order to dry the garments cleaned in such machines, it is generally necessary to remove them from the washing machine and place them in a separate mechanical dryer which tumbles the damp garments in a stream of hot air until they are dry. This removal step, particularly for garment manufacturers processing large volumes of garments, unnecessarily consumes manufacturing time and floor space.

Because of the simplicity of construction, desirability of access to the interior of the sealed drum, and smaller water and washing chemical requirements, attempts have been made to construct single, water impermeable drum washing machines. See, for example, U.S. Pat. No. 2,397,268 to Jorgenson et. al. and U.S. Pat. No. 2,434,570 to Leef. However, these machines cannot extract excess wash or rinse water from garments as efficiently as the two drum machines, necessitating longer drying times.

Therefore a need exists for a commercial, single drum washing machine which can wash or process garments using only the minimum amount of water needed to wash the garments and which can then extract waste wash and rinse water from the garments as efficiently as a two drum washing machine. A further need exists for a commercial, single drum fabric finishing machine which can process, wash and completely dry garments in one operation.

SUMMARY OF THE INVENTION

The present invention provides a liquid impermeable single drum washing machine in which spent wash water can be efficiently removed.

In one embodiment, the present invention includes a liquid impermeable, single drum. The drum has a frustum shaped interior, a back end at the base of the frustum, an opposite front end which is smaller than the back end, and an imperforate wall which slopes smoothly from the smaller front end to the larger back end. The drum is mounted for rotation about a horizontal axis passing substantially through the center of the back end and front end. A sealable door or hatch for loading and unloading the drum is also provided, preferably at the front end. The front end is provided with an inlet aligned substantially with the horizontal axis of rotation, and the back end is provided with an outlet aligned substantially with the horizontal axis of rotation. When the door is mounted in the front end, the inlet is mounted in the door to be substantially aligned with the horizontal axis of rotation.

In the preferred embodiment, the inlet and outlet are inserted into the drum through sealed bearings to enable the inlet and outlet to remain stationary when the single drum rotates. A perforated panel is mounted in the drum parallel to and spaced away from the back end. A housing, stationary in use and shaped to conform to the space between the back end and the perforated panel is provided with a flexible flap which rests against the wall of the drum. This housing is connected to the outlet opening inside the drum. The drum is supported in a frame which incorporates a motor drive for rotating the drum. Water, cleaning fluids, or other chemicals pass into the drum through the inlet until the desired fluid level is attained, then the inlet and outlet are closed and the wash cycle is accomplished by slow rotation. Because washing machines can be used for processing garments during manufacture, as well as for cleaning garments, the terms "wash" and "wash cycle", as used in this application, can include cleaning, removing sizing, dyeing, and other chemical processing. Following the wash cycle, the spent solution is removed from the drum by rotation at high speed. This forces the water in the drum against the interior wall of the drum by centrifugal force. Because of the frustum shape of the drum, centrifugal force also moves water along the sloped interior wall to the back end where it can be removed from the drum through the outlet. As the water moves past the perforated panel towards the back end, the water will be directed by the flexible flap of the stationary housing from the rotating wall into the stationary nozzle where it may be pumped out of the drum through the outlet.

In yet another embodiment, the present invention provides a combination washer and dryer. In this embodiment, the washing machine described above is additionally provided with a source of warm air which can be pumped into and out of the drum through the inlet and the outlet. This embodiment is particularly advantageous in that garments can be cleaned and dried in one operation without the necessity of unloading the wet garments from one machine and loading them into a second machine for drying.

BRIEF DESCRIPTION OF THE DRAWINGS

A better understanding of the invention and its advantages will be apparent from the detailed description taken in conjunction with the accompanying drawings in which:

FIG. 3 is a vertical sectional side view of the washing machine drum taken through 3—3 of FIG. 2;

FIG. 4 is a vertical sectional view of the back end of the interior of the drum taken through 4—4 of FIG. 3;

FIG. 5 is a vertical sectional view of the front end of the drum taken through 5—5 of FIG. 3;

FIG. 6 is a fragmentary view of FIG. 3 showing an alternate preferred embodiment where screens are mounted between the hollow ribs; and, FIG. 7 is a sectional view taken through 7—7 of FIG. 6.

DETAILED DESCRIPTION

Figure 1:
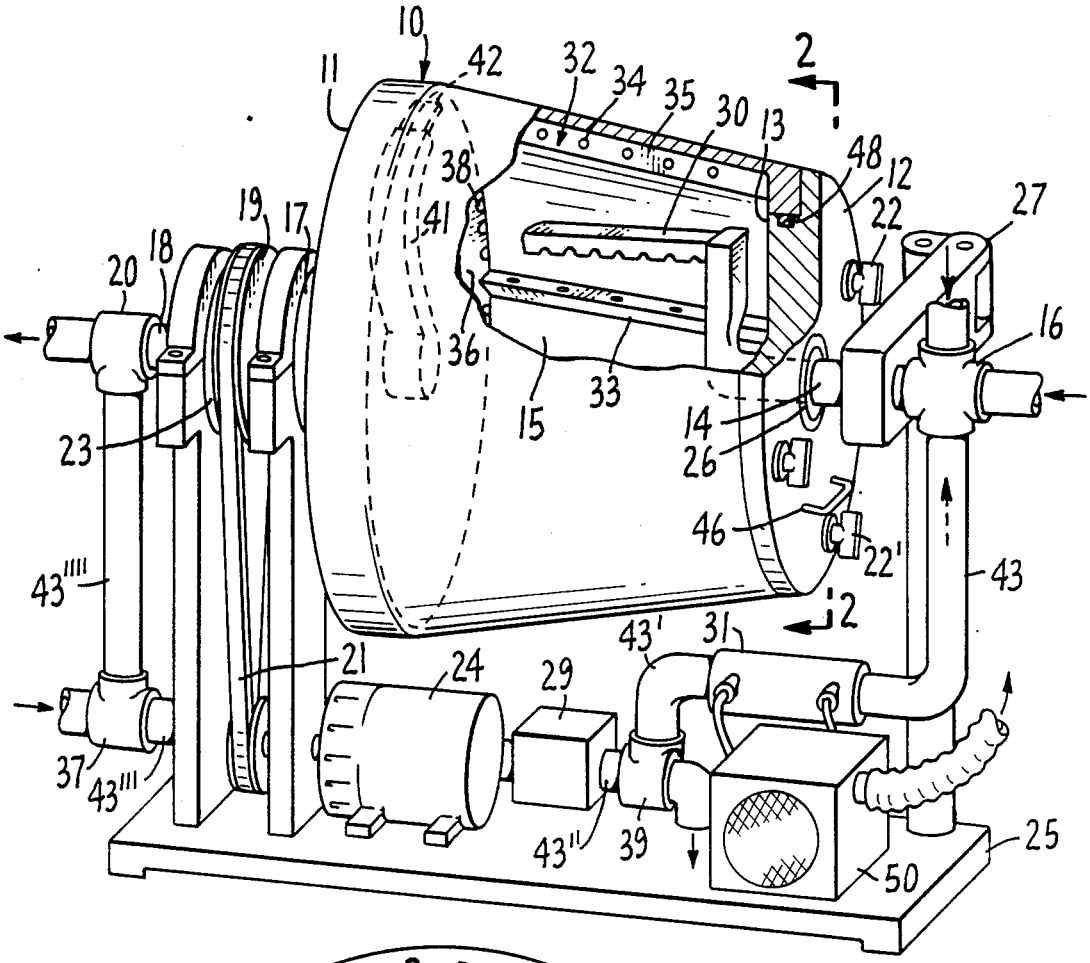
FIG. 1 is a partially cut away perspective view of the washing machine of the present invention.

FIG. 1 shows a washing machine of the present invention. The single, water impermeable drum 10 has a frustum shaped interior with the base of the frustum forming a back end 11. A smaller front end 13 is provided with an access door 12 for loading and unloading garments, and for sealing the front end 13 to prevent the escape of liquids pumped into the drum 10 during the cleaning and rinsing cycles. The door 12 may be secured in place to seal the front end 13 using fasteners 22. For convenience, the door 12 can be supported when it is removed from the drum 10 by providing a hinged support 27 attached to the inlet 14 Alternatively, but less advantageously, the door 12 can be mounted on the side of the drum 10, as shown in U.S. Pat. No. 2,800,786 to Schang which is incorporated herein by reference, or in the back end 11.

The interior wall 15 of the drum 10 is imperforate and smoothly slopes from the smaller front end 13 to the larger back end 11. The slope shown in the figures is exaggerated for purposes of illustration. In actual practice, a slope of 1/10,000 inch has been found to be effective in removing water by centrifugal force as described below. The drum 10, although shown with an exterior frustum shape, can be modified to have other exterior shapes which may improve rotational stability about a horizontal axis of rotation passing substantially through the center of both the back end 11 and the front end 13. For example, it would be possible to construct a drum having a frustum interior and a cylindrical exterior.

The frustum shaped interior is particularly advantageous for removing water from the drum 10 since, by rapidly rotating the drum 10 about the horizontal axis of rotation, centrifugal force will move any water inside the tank first against the interior wall 15 and then along the sloped wall toward the back end 11 where the water can be collected and removed from the drum 10.

The water impermeable drum 10 is provided with an outlet 18 and an inlet 14. The outlet 18 provides a conduit from interior to the exterior of the drum 10. The outlet 18 is mounted in the back end 11 to provide a substantially water impermeable seal between the outlet 18 and the back end 11 and is substantially aligned with the horizontal axis of rotation. The outlet 18 can be fitted with an outlet valve 20 which can be selectively operated, either automatically or manually, either to seal the drum 10 or to open a conduit between the interior of the drum 10 and other environments such as, for example, a pump 29 and drain or the atmosphere. Likewise, the inlet 14 provides a conduit from the exterior to the interior of the drum 10. The inlet 14 is mounted in the front end 13 to provide a substantially water impermeable seal and is substantially aligned with the horizontal axis of rotation. If the front end 13 is provided with the door 12, then the inlet 14 is mounted in the door 12 such that when the door 12 is secured in place against the front end 13, the inlet 14 is substantially aligned with the horizontal axis of rotation of the drum 10. The inlet 14 can be fitted at its exterior end with an inlet valve 16 which can be selectively operated, either automatically or manually, either to seal the drum 10 or to open a conduit between the drum 10 and other environments such as, for example, a source of cleaning fluids such as water or processing solutions and a pump 29, a source of forced air 50, or the atmosphere. The interior end of the inlet 14 can be fitted with a nozzle 30 for more even distribution of water or chemicals introduced into the drum 10 during the wash cycle. As best shown in broken line fashion in FIG. 2, the nozzle 30 is oriented at about a 2 o'clock position, assuming a clockwise rotation of the drum 10, when viewed from the front of the drum. This allows the chemicals or cleaning solution to be sprayed on the garments as they tumble through the air inside the drum 10.

The drum 10 is mounted for rotation in a support stand 25. The support stand 25 can include a motor drive 24 for rotating the drum 10 and can, as a matter of convenience, include a hinged support structure 27 attached to the inlet 14 for supporting the door 12 when the door 12 is removed from the front end 13. The drum 10 can be mounted for rotation by forming a hollow shaft 17 at the back end 11. The hollow shaft 17 should be of sufficient thickness and strength to serve as the sole support for the drum 10. The hollow shaft 17 can be attached to the support stand 25 using bearings 23 to promote the unobstructed rotation of the hollow shaft 17 and the drum 10. Further, a flanged wheel 19 or similar structure can be provided on the hollow shaft 17 to permit the attachment of a belt 21 or similar structure to a motor or other means 24 for rotating the shaft 17 and the drum 10. Many other methods and variations for rotating horizontal drums are known to those skilled in the art. Typical means are disclosed in U.S. Pat. No. 2,397,268 to Jorgenson et. al. and U.S. Pat. No. 2,434,570 to Leef which are incorporated herein by reference.

A source of forced air 50, such as an air compressor or fan assembly, can also be optionally provided. Preferably the air source 50 can provide heated air. The air source 50 is preferably connected to the inlet valve 16 to provide a stream of air through the drum 10 from the inlet 14 to the outlet 18 where the air stream exits drum 10. However, it is also possible to connect the air source 50 to the outlet valve 20 to provide a stream of air through the drum 10 from the outlet 18 to the inlet 14 where the air stream exits the drum 10. Thus, the air source 50 can be used to dry garments immediately following washing and rinsing.

A means for recirculating the cleaning fluids through the drum 10 is also preferably provided. This recirculating means includes a pump 29 for recirculating the fluids and hoses 43, 43', 43'', 43''' and 43'''' for connecting the pump 29 to outlet valve 20 and inlet valve 16. A heating element 31, such as, for example, an immersion heater, can be provided for heating the cleaning fluids being recirculated. This is particularly useful in dyeing operations, when temperatures above 212 degrees fahrenheit are required. For example, to properly dye man-made fabrics like polyester, temperatures in the range of about 240 degrees to about 260 degrees fahrenheit are typically required. With temperatures in this range, and the generation of steam, pressures inside drum 10 are expected to reach about 35 to about 40 psi above atomospheric pressure.

A cleaning fluid inlet valve 37 and a drain outlet valve 39 can be provided between the outlet valve 20 and pump 29 and between pump 29 and inlet valve 16 as shown in FIG. 1 to permit the use of pump 29 for draining, filling and recirculating. However, one skilled in the art will recognize that many different valving arrangements are possible which will permit these functions to be carried out by a single pump.

Figure 2:
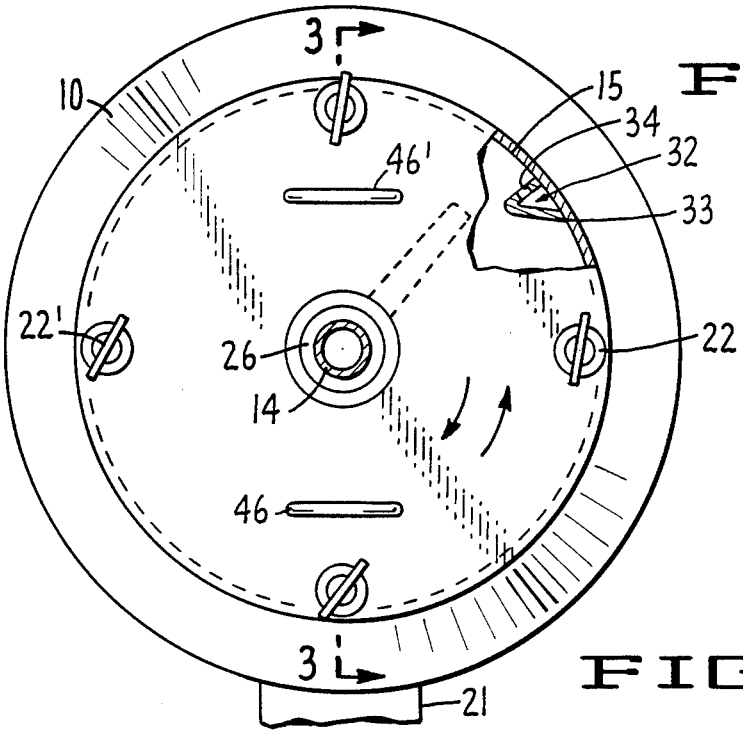
FIG. 2 is a front view of the washing machine drum showing the front end with a removably sealable door attached, taken through section 2—2 of FIG. 1 and with portions broken away.

FIG. 2 shows the front end 13 of the drum 10 with door 12 attached. A plurality of fasteners 22, 22' can be tightened to seal the door 12 on the drum 10 or loosened to remove the door 12 from the drum 10 to provide access to the interior of the drum 10, for example for loading and unloading garments. Handles 46, 46' can be provided to assist an operator in seating and removing the door 12.

FIGS. 3, 4, 5, 6 and 7 show clearly the interior of the drum 10. A seal 48 is provided at the front end 13 interface to seal the drum 10 when the door 12 is mounted to the front end 13.

A perforated panel 36 is attached to the interior wall 15 of the drum 10 such that it is preferably parallel to and spaced away from the back end 11. The distance between the back end 11 and the perforated panel 36 may vary depending upon the size of the washing machine and the structure used to remove wash water from the interior wall 15 between the perforated panel 36 and the back end 11, but preferably will vary from about 1 inch to about 6 inches for most applications. The location, size and number of the perforations 38 in the perforated panel 36 may also vary, but preferably such perforations are at least located at the periphery of the panel 36 to promote the free flow of water along the slope of the interior wall 15 to the area between the perforated panel 36 and the back end 11.

The drum 10 preferably includes hollow vanes 32 attached to the interior wall 15 and extending axially between the perforated panel 36 and the front end 13 to provide additional agitation of the garments and water during washing and to promote efficient removal of water following washing. The hollow vanes 32 are preferably constructed with a first side 33 and a second side 35. The first vane side 33 is preferably imperforate and forms an acute angle with the interior wall 15 when the vane 32 is mounted to the interior wall 15. Most preferably, the first vane side 33 will form an angle of about 45 degrees when the vane 32 is mounted to the interior wall 15. The second vane side 35 is preferably perforated to provide multiple conduits connecting the interior of the drum 10 to the hollow interior of the vanes 32. The vane side 35 preferably forms an angle of about 90 degrees with the interior wall 15 when the vane 32 is mounted to the interior wall 15.

The vanes 32 are most preferably mounted to extend axially between the perforated panel 36 and the front end 13 such that the hollow interior of each vane 32 abuts a perforation 38 on the perforated panel 36 to promote the flow of water through each hollow vane 32 and beyond the perforated panel 36 to the region between the back end 11 and the perforated panel 36. Using this particular orientation of the vanes 32, when the drum 10 is rotated in one direction, such as during a wash cycle, the first vane side 33 provides an imperforate leading edge for contacting the garments during agitation; when the drum rotation is reversed and the speed of rotation increased, for removing water from the drum 10, the perforate second vane side 35 is the leading edge, providing a plurality of unobstructed conduits for extracting the water by centrifugal force.

One or more removable screens 44 may be used in the drum 10. The screens 44 are preferably spaced away from the interior wall 15 and preferably secured during use between the vanes 32. The screens can be constructed of an abrasive material if it is desired to provide the garments with a "stone-washed" look. In dyeing operations, the use of such screens is advantageous because they can be removed when subsequent batches of garments are to be treated with a different colored dye. Other screens, previously used with the new dye, could then be inserted. Further, because the wall 15 is imperforate, the drum 10 is easier to clean of any residual dye from the previous dyeing operation. The use of the screens 44 is additionally advantageous in that they provide additional perforate surfaces for extracting water from garments using centrifugal force thus decreasing the time required to extract excess water from the garments.

The inlet 14 is substantially aligned with the horizontal axis of rotation of the drum 10 and is mounted to the door 12 through one or more sealed bearings 26 mounted in the door 12. This enables the inlet 14 to remain stationary while the drum 10 and the door 12 rotate around it. A nozzle 30 may be attached to the interior end of the inlet 14 to aid in the even distribution of water, soap solution, or other fabric cleaning or treating chemicals. The nozzle 30 is oriented at about a 2 o'clock position, assuming a clockwise rotation of the drum 10, when viewed from the front of the drum. This allows the chemicals or cleaning solution to be sprayed on the garments as they tumble through the air inside the drum 10. An inlet valve 16, described above, may be attached to the exterior end of the inlet 14.

The outlet 18 is substantially aligned with the horizontal axis of rotation of the drum 10 and is mounted to the back end 11 by passing through one or more sealed bearings 28 mounted either in the back end 11 or in the hollow shaft 17, if the drum 10 is constructed to include a hollow shaft 17. This enables the outlet 18 to remain stationary while the drum 10, and the hollow shaft 17 if present, rotate around it. An outlet valve 20, as described above, may be attached to the exterior end of the outlet 18. A water extractor 40 is attached to the interior end of the outlet 18. While outlet 18 can be fixed, it preferably is rotatable to preselected positions in order to change the relative position of the housing 41 of water extractor 40.

The water extractor 40 consists of a stationary housing 41 and a flexible flap or squeegee 42 which fit in the space between the back end 11 and the perforated panel 36. The housing 41 is preferably curved and positioned as shown in solid line fashion in FIG. 4 to funnel water from the mouth of the housing 41 to the outlet 18 during fluid extraction. The flexible flap or squeegee 42 is attached to the mouth of housing 41 and extends from the mouth of the housing 41 to the interior wall 15. The flexible flap 42 is preferably constructed from a stiff but somewhat flexible rubber strip having a cross-sectional profile which is thicker where the flap attaches to the housing 41 than where the flap 42 touches the interior wall 15. This allows the flexible flap 42 to operate somewhat like a windshield wiper blade or a window washer's squeegee and "wipe" the water from the smooth interior wall 15 and into housing 41. Unlike windshield wiper blades and squeegees, however, the flexible flap 42 will preferably wipe up water using the leading edge rather than the trailing edge. Thus, when the water extractor 40 is assembled, mounted on the interior end of the outlet 18, and positioned as shown in solid line fashion in FIG. 4, and when the drum 10 as depicted in FIG. 4 is rotating counterclockwise at a sufficient speed to force the water extracted from the garments into the region between the perforated panel 36 and the back end 11, the water will contact the leading edge of flexible flap 42, and will wiped off the interior wall 15 as drum 10 rotates and into the mouth of housing 41. Although the speed of movement of the water will slow down as it contacts the flexible flap 42 and enters the stationary housing 41, the water will retain sufficient momentum to move well into the housing 41. The shape and orientation of the housing 41 are such that the water will be sufficiently within the housing by the time it loses much of the momentum imparted by the rotational motion of the drum 10, so that gravity can act upon the water to complete the flow to the outlet 18 where the water can be removed entirely from the drum 10, for example, by pumping. The preferred "C" shaped curve and orientation of the housing 41, as shown in FIG. 4, is also particularly advantageous because such a shape helps to maintain the momentum imparted to the water by the rotation of the drum as the water enters the mouth of the stationary housing 41.

Water extractor 40 can also be used as a means of sensing and controlling the level of cleaning fluids in drum 10. For example, housing 41 can be provided with a water sensor (not shown) which functions when housing 41 is set to an alternate position, such as that shown in broken line fashion in FIG. 4. The mouth of housing 41 is set to the approximate desired fluid level. Thus, cleaning fluids in the mouth of housing 41 can be sensed and the inflow of cleaning fluids stopped.

A washing machine constructed as described above can thus be efficiently used to both wash and dry garments. Connections to a cleaning fluid source and to the forced air source 50 can be made through the inlet valve 16 which can have, for example: a first position opening a conduit between the interior of the drum 10, pump 29, and cleaning fluid valve 37 which would be in an open position for pumping cleaning fluid from a cleaning fluid source; a second position opening a conduit between the interior of the drum 10 and the atmosphere; a third position opening a conduit between the interior of the drum 10 and the air source 50; and, a fourth position closing the inlet 14. Connections to a pump 29 and a drain can be made through the outlet valve 20 which can have, for example: a first position opening a conduit between the interior of the drum 10 and the atmosphere; a second position closing the outlet 18; and, a third position opening a conduit between the interior of the drum 10, pump 29 and drain valve 39 which would be in an open position to permit fluid to be pumped into a drain.

To use a machine configured in this way to wash garments, door 12 is first opened by loosening fasteners 22, 22' and swinging the door 12 away from the front end 13. Garments are next placed inside the drum 10, and the door 12 replaced by seating it against the seal 48 and tightening the fasteners 22, 22'. By placing the inlet valve 16 in the first (fluid input) position, the cleaning fluid valve 37 in the open position, the outlet valve 20 in the first (atmosphere) position, and activating pump 29, cleaning fluid is pumped into the drum 10 through the inlet 14, displacing air through the outlet 18. The water height is preferably chosen to be the minimum amount of water necessary to wash the garments so that later extraction of the water is facilitated and the amount of soaps or other chemicals required are accordingly reduced. When the water level has reached the desired height, as determined by the position of housing 41, the pump 29 is deactivated, inlet valve 16 is moved to the fourth (closed) position, cleaning fluid valve 37 is closed, and the outlet valve 20 is moved to the second (closed) position, and the motor drive 24 is actuated to begin rotation of the drum 10. The speed of the drum is preferably adjusted to exert about 0.9 g's on the garments in the drum. This will allow the garments to drop from about the 10:00 o'clock or 11:00 o'clock position, as viewed from the front of the machine as shown in FIGS. 2, 4 or 5.

If the machine is constructed as shown in the drawings, rotation would be clockwise when the drum 10 is viewed from the front end 13. During this washing cycle, the clothes and cleaning fluid are agitated by the relatively slow rotation of the drum 10 and the imperforate first side of the hollow vanes 32.

When the washing cycle is complete, the rotation of the drum 10 can be stopped and the position of housing 41 can be changed to facilitate draining, for example, by placing the mouth of the housing 41 at its lowest position in the drum. The inlet valve 16 can be moved to the second (atmosphere) position, and the outlet valve 20 can be moved to the third (vacuum pump/drain) position, drain valve 39 can be opened, and pump 29 activated to remove some, if not most, of the fluid in drum 10. When the fluid level falls below the position of the mouth of housing 41, housing 41 can be moved to the position shown in solid line fashion in FIG. 4 and the remaining fluid can be removed by rotating the drum counterclockwise and increasing the speed of rotation to exert about 300 G'S on the garments in the drum. During this "spin" cycle, the perforated second side of the hollow vanes 32 contacts the water which is forced against the interior wall 15 of the drum 10 by centrifugal force. Because the interior of the drum 10 is sloped outward from the front end 13 towards the back end 11, the water moves through the perforations 34 and into the hollow vanes 32, traveling unobstructed through the vanes 32 towards the back end 11. When this water passes through the perforated panel 36, it is quickly moved by the rotation of the drum 10 to the flexible flap 42 which wipes the moving water from the moving interior wall 15 and into the housing 41, where the water is pumped out of the drum 10 through the outlet 18 and into a drain.

As the cleaning fluid is removed, the garments are forced against the interior wall 15 of the drum 10 (or if the removable screens 44 are in place, the garments will be forced against the removable screens 44) by centrifugal force. The residual water retained by the fabric is drawn through the fabric and against the interior wall 15 where it moves into the hollow vanes 32 through the perforations and travels unobstructed through the perforated panel 36 and into the back end 11 of the drum 10 where it is removed in the same manner as discussed above.

When the spin cycle is complete, it may be desirable to rinse the garments. This can be accomplished by performing another wash cycle using water and performing another spin dry cycle.

To use the recirculation system, for example in dyeing operations, the drum is filled with dyeing solution as described above for filling the drum with cleaning fluid by connecting cleaning fluid valve 21 to a source of dyeing solution. When the desired level is reached, inlet valve 16 remains in the first position, outlet valve 20 is placed in the third (drain) position, cleaning fluid valve 21 is closed, drain valve 39 is closed, and pump 29 is activated. Thus, dye can be continuously recirculated through drum 10 and sprayed on the tumbling garments through nozzle 30. Where desired, heater 31 can be activated to heat the dyeing solution or create steam to improve the quality of the dyeing operation. When recirculation is complete, the drum is drained as described above.

To dry the garments, the speed of rotation of the drum 10 is decreased, the inlet valve 16 is moved to the third (forced air) position, the outlet valve 20 is moved to the first (atmosphere) position, and the air source 50 is actuated to direct a stream of air into the drum 10 from the inlet 14 through the outlet 18 and out of the drum 10. The drum 10 may be slowly rotated in either direction to tumble the garments through the flowing stream of air. Drying time may be reduced significantly if the air flowing through the drum 10 is heated.

When the garments are sufficiently dry, the motor drive 24 for rotating the drum 10 is deactuated, the air source 50 is deactuated, the fasteners 22, 22' are unlocked, the door 12 is removed from the front end 13 and the clean, dry, finished garments are removed from drum 10. In some embodiments, removal of the garments can be accomplished by tilting the entire support stand 25 vertically to dump the garments out of the front end One skilled in the art will recognize at once that it would be possible to construct the various components of the present invention from a variety of materials and to modify the structures disclosed herein in a variety of ways. While the preferred embodiment has been described in detail and shown in the accompanying drawings, it will be evident that various further modifications are possible without departing from the scope of the invention as embodied in the claims.

I claim:

1. A washing machine comprising:

a drum including a frustum shaped, substantially liquid impermeable interior wall, a back end, and a front end opposite the back end, a perforated panel mounted inside the drum such that the perforated panel is substantially parallel to and spaced away from the back end, and a fluid tight door mounted in the drum for providing access to the interior of the drum;

means for supporting and rotating the drum about a horizontal axis of rotation passing substantially through the center of the back end and the center of the front end of the drum;

an outlet passing through the back end of the drum, the outlet being substantially aligned with the horizontal axis;

an inlet passing through the front end of the drum, the inlet being substantially aligned with the horizontal axis of rotation;

a liquid removing means attached to the outlet and located between the back end and the perforated panel; and a plurality of ribs mounted inside the drum and axially extending substantially from the perforate panel to the front end, the washing machine having a wash cycle and a spin cycle, wherein the drum rotating means rotates the drum in one direction during the wash cycle such that when the drum contains water and garments the first side of the ribs will agitate the water and garments, and wherein the drum rotating means rotates the drum in an opposite direction during the spin cycle such that the garments and water will contact the second side of the ribs.

2. The washing machine of claim 1 wherein each rib is hollow and has an imperforate first side forming an acute angle with the interior wall of the drum, and a perforated second side forming an angle of about 90 degrees with the interior wall of the drum.

3. The washing machine of claim 1 additionally comprising one or more removable screens mounted inside the drum against the interior wall and positioned between the perforate panel and the front end.

4. A washing machine comprising:

a drum including a frustum shaped, substantially liquid impermeable interior wall, a back end, and a front end opposite the back end, the front end being smaller in diameter then the back end, a perforated panel substantially parallel to and spaced away from the back end, and a fluid tight door mounted in the drum for providing access to the interior of the drum;

means for supporting and rotating the drum about a horizontal axis of rotation passing substantially through the center of the back end and the center of the front end of the drum;

an outlet passing through the back end of the drum, the outlet being substantially aligned with the horizontal axis;

an inlet passing through the front end of the drum, the inlet being substantially aligned with the horizontal axis of rotation; and, a liquid removing means attached to the outlet and located between the back end and the perforated panel, the liquid removing means comprising a housing having a mouth and a flexible flap extending from the mouth of the housing to the interior wall of the drum and between the back end and the perforate panel in a position for directing liquid which flows along the interior wall of the drum into the outlet.

5. The washing machine of claim 4 in which the relative position of the mouth of the liquid removing means can be changed.

6. The washing machine of claim 5 in which the liquid removing means comprises a means for sensing the level of water in the drum.

7. The washing machine of claim 1 in which the inlet includes an inlet valve means for operatively attaching the washing machine to and selectively opening a conduit between the drum and a source of liquid, forced air and atmosphere.

8. The washing machine of claim 1 in which the outlet includes an outlet valve means for operatively attaching the apparatus to and selectively opening a conduit between the drum and a pump, a drain, and atmosphere.

9. The washing machine of claim 1 in which the outlet enters the back end and the inlet enters the front end through one or more packed bearings which provide a fluid tight seal and which rotate with the drum, enabling the outlet and inlet to remain substantially stationary when the drum is rotating.

10. The washing machine of claim 9 wherein the inlet comprises a nozzle extending to the upper interior portion of the drum for spraying one or more chemicals on the garments within the drum.

11. The washing machine of claim 1 in which the door for providing access to the interior of the drum is mounted in the front end of the drum, with the inlet being mounted in the door such that when the door is attached to the front end the inlet will be substantially aligned with the horizontal axis of rotation.

12. The washing machine of claim 1, further comprising a source of forced air operatively connected to the drum for providing a flow of air through the drum for drying washed garments.

13. The washing machine of claim 12 in which the source of forced air additionally comprises a heater for providing heated air to the garments in the drum.

14. The washing machine of claim 1 wherein the slope of the interior drum wall from the front end to the back end is 1/10,000 inch over its length.

15. The washing machine of claim 1 further comprising a means for recirculating fluid through the drum.

16. The washing machine of claim 15 in which the means for recirculating includes a pump having an input and an output, a first conduit for connecting the pump input to the outlet, and a second conduit for connecting the pump output to the inlet.

17. The washing machine of claim 16 additionally including a heater for raising the temperature of the fluid being recirculated.

18. An apparatus for finishing garments comprising:

a means for supporting and rotating a drum;

a single, substantially fluid tight, rotatable drum having a horizontal axis of rotation and mounted on the means for supporting a drum in such manner as to promote rotation about the horizontal axis of rotation, the drum further having (a) a frustum shaped interior including a back end, a front end opposite the back end, the front end being smaller than the back end, and an interior wall sloping substantially smoothly from the front end to the back end, the horizontal axis of rotation passing substantially through the center of said back end and the center of said front end, (b) an inlet mounted in the front end of the drum, said inlet being substantially axially aligned with the horizontal axis of rotation, said inlet entering the front end of the drum through one or more packed bearings which provide a fluid tight seal and which rotate with the drum enabling the inlet to remain substantially stationary when the drum is rotating, (c) an outlet mounted in the back end of said outlet being substantially axially aligned with the horizontal axis of rotation, said outlet entering the back end of the drum through one or more packed bearings which provide a fluid tight seal and which rotate with the drum, enabling the outlet to remain substantially stationary when the drum is rotating, (d) a perforated panel mounted substantially parallel to and spaced away from the back end inside the drum, (e) a plurality of hollow ribs mounted on the interior wall and extending axially between the perforated panel and the front end, each said rib having an imperforate first side and a perforate second side, (f) a liquid removing means attached to the outlet and located between the back end and the perforated panel, said liquid removing means including a housing and a flexible flap extending from the housing to the interior wall, and, (g) a fluid tight door mounted in the drum for providing access to the interior of the drum;

a means for directing a stream of air into the inlet, through the drum, and out of the outlet; and, a motorized means for rotating the drum about the horizontal axis of rotation operably attached to the drum.

19. The apparatus of claim 18 in which the hollow ribs are mounted such that the imperforate first side of the ribs forms an acute angle with the interior wall of the drum, and the perforated second side of the ribs forms an angle of about 90 degrees with the interior wall of the drum.

20. The apparatus of claim 18 having at least a wash cycle, a spin cycle, and a drying cycle wherein the motorized means for rotating the drum rotates the drum in one direction during the wash cycle such that the imperforate first side of the ribs will provide a leading edge for agitating water or garments introduced into the drum, and wherein the motorized means rotates the drum in an opposite direction during the spin cycle such that the perforated second side of the ribs will provide a leading edge for promoting the extraction of water from the interior of the drum.

21. The apparatus of claim 18 additionally comprising one or more removable screens mounted inside the drum adjacent to and spaced away from the interior wall and positioned between the perforated panel and the front end.

22. The apparatus of claim 18 in which the inlet includes an inlet valve means and the outlet includes an outlet valve means for operatively attaching the apparatus to and selectively opening conduits between the interior of the drum and external environments.

23. The apparatus of claim 18 in which the door for providing access to the interior of the drum is mounted in the front end of the drum, with the inlet passing into the drum through one or more packed bearings in the door such that when the door is operably attached to the front end the inlet will be substantially aligned with the horizontal axis of rotation and such that the inlet remains substantially stationary when the drum and attached door rotate.

24. The apparatus of claim 18 additionally comprising a pump for pumping fluids from a fluid source into the drum through the inlet, pumping fluids from the drum through the outlet and into a drain, and for recirculating fluids through the drum.

25. The apparatus of claim 24 additionally comprising a means for raising the temperature of fluids which are recirculated through the drum by the pump.

26. A liquid impermeable, rotatable drum for washing machine comprising:

a generally water tight circular shaped back end;

a generally water tight circular shaped front end parallel to and opposite the back end, the front end having a smaller circumference than the back end;

an interior drum wall which extends imperforately and slopes substantially smoothly from said front end to said back end to form a frustum shaped interior;

a horizontal axis of rotation passing through the center of the back end and the center of the front end;

an outlet mounted in the back end and substantially aligned with the horizontal axis of rotation;

as inlet mounted in the front end and substantially aligned with the horizontal axis of rotation;

a perforated panel mounted parallel to and spaced away from the back end;

a plurality of hollow ribs mounted to the interior wall, and extending axially between the perforated panel and the front end, each said rib having an imperforate first side forming an acute angle with said interior wall and a perforated second side forming an angle of about 90 degrees with said interior wall;

a means for removing water from the interior wall between the back end and the perforated panel, said means attached to the outlet; and a sealable door for providing access to the interior of the drum.

* * * * *